US006431649B1

(12) United States Patent
Hensel

(10) Patent No.: US 6,431,649 B1
(45) Date of Patent: Aug. 13, 2002

(54) WORKING CHAIR WITH SYNCHRONOUS SEAT AND BACK ADJUSTMENT

(75) Inventor: Willi B. Hensel, Willingen (DE)

(73) Assignee: Labofa A/S, Skaelskor (DK)

( * ) Notice: Subject to any disclaimer, the term of this patent is extended or adjusted under 35 U.S.C. 154(b) by 0 days.

(21) Appl. No.: 08/591,599

(22) PCT Filed: Oct. 27, 1994

(86) PCT No.: PCT/DK94/00395

§ 371 (c)(1),
(2), (4) Date: Jun. 28, 1996

(87) PCT Pub. No.: WO95/12338

PCT Pub. Date: May 11, 1995

(30) Foreign Application Priority Data

Nov. 1, 1993 (DK) ..... 1232/93
Nov. 1, 1993 (DK) ..... 1233/93

(51) Int. Cl.[7] ..... A47C 1/024
(52) U.S. Cl. ..... 297/300.2; 297/316
(58) Field of Search ..... 297/300.2, 316, 297/354.1, 300.1, 285

(56) References Cited

U.S. PATENT DOCUMENTS 2,471,024 A * 5/1949 Cramer ..... 297/354.1 X
4,596,421 A * 6/1986 Schmitz ..... 297/316
4,773,706 A * 9/1988 Hinrichs ..... 297/316 X
4,848,841 A * 7/1989 Giselsson ..... 297/316 X
4,854,641 A * 8/1989 Reineman et al. ... 297/300.2 X
5,261,727 A * 11/1993 Klaebel ..... 297/316 X
5,308,144 A * 5/1994 Korn ..... 297/300.2

* cited by examiner

*Primary Examiner*—Peter M. Cuomo
*Assistant Examiner*—Stephen Vu
(74) *Attorney, Agent, or Firm*—Sughrue Mion, PLLC

(57) ABSTRACT

In a working chair with a seat (12), a back (14) and a lower frame the seat (12) is pivotally connected in the proximity of the front edge with a carrier frame (11) whereas a back support (15) connected with the back (14) is pivotally connected with the carrier frame (11) as well as with the seat (12). The pivot connections are provided for synchronous movement of the seat (12) and the back (14), whereby the seat from a backwards inclining extreme position may be moved to a forwards inclining extreme position and the back (14) synchronously therewith from a backwards inclining position in which it forms a maximum angle with the seat towards a more erect position, while gradually reducing its angle with the seat. The pivot connection (13) between the seat (12) and the carrier frame (11) is formed to allow a perpendicular, substantially translatory movement of the seat (12) so that the front edge of the seat (12) in said forwards and backwards inclining extreme positions is displaced forwards and upwards, backwards and downwards, respectively, in relation to the carrier frame (1, 11).

11 Claims, 5 Drawing Sheets

WORKING CHAIR WITH SYNCHRONOUS SEAT AND BACK ADJUSTMENT

BACKGROUND OF THE INVENTION

1. Field of the Invention

The invention relates to a working chair with a seat, a back and a lower frame, of which the frame comprises a vertical supporting pillar adjustable as to height and a carrier frame connected with the upper end of said pillar. The seat is pivotally connected with the carrier frame in the proximity of its front edge by a first pivot connection with a horizontal axis of rotation. The first pivot connection comprese a pivot pin connected with the seat or the carrier frame, the other of the seat and the carrier frame being provided with a track inclined with respect to the horizontal for allowing a substantially translatory movement of the seat perpendicular to the axis of rotation with respect to said carrier frame. A mounting arm in firm connection with a back support connected with the back is pivotally connected with the carrier frame as well as with the seat by second and third pivot connections having axes of rotation mutually parallel and parallel with the axis of said first pivot connection. The pivot connections are designed for synchronous movement of the seat and the back, whereby the seat from a backwards inclining rest position by rotation in said first pivot connection may be moved to a working position and the back synchronously therewith may be moved from a backwards inclining extreme position in which it forms a maximum angle with the seat towards a more upright position while gradually reducing its angle with the seat.

2. Prior Art

From EP-A-0418731 such a working chair is known in which the seat can be moved between a backwards inclining rest position and a working position in which the seat is horizontal and forms an angle of approximately 90° with the back support.

It is known to design a working chair of the type referred to with an extended range of variation of the seat inclination so that the seat angle with respect to horizontal may be adjusted from the backwards declining rest position to a forwards declining supporting position for the user in a more erect position.

In connection with such an extended range of adjustment in relation to conventional working chairs it is, moreover, known to provide a working chair of the kind concerned with a synchronous mechanism which automatically sets the angular adjustment of the back support in relation to the seat, typically so that the angle between the seat and the back support increases the more the seat inclines backwards, conversely it, decreases when the seat from the backwards inclining rest position is moved towards the forwards inclining supporting position.

In some known synchronous chairs with the last mentioned possibility of adjustment a continuous diminishing of the seat-back angle is effected throughout the range of adjustment of the seat from the backwards declining rest position to the forwards declining supporting position, so that said angle in the forwards declining extreme position of the seat is smaller than in the neutral position of the chair, in which the seat plane is substantially horizontal.

This continuous reduction of the seat-back angle has, however, shown to be a disadvantage when using the chair because the user typically has the feeling that the seat and back collapse during the adjustment movement after the neutral position has been passed.

To eliminate this disadvantage and thereby obtain an increased seat angle with the horizontal in the forwards right extreme position the Applicant has further developed a chair with a design of the synchronous mechanism which causes that the seat-back angle during the adjustment movement assumes its minimum value in the proximity of said neutral position with a substantially horizontal seat plane, but increases again from said minimum value while continuously adjusting the seat towards the forwards declining extreme position.

SUMMARY OF THE INVENTION

The object of the invention is to provide a further development of a synchronous chair with the last mentioned usefully advantageous variation of the seat-back angle during the adjustment movement so that an automatical setting of the seat depth is effected as well so that this increases at forwards as well as at backwards declination of the seat.

This is obtained according to the invention in that the track is directed obliquely upwards towards the front edge of the seat and is inclined at an angle of 40° to 70° with the vertical axis of the supporting pillar to provide a range of said translatory movement by which the seat is movable from said backwards declining rest position in which the front edge of the seat is displaced backwards and downwards with respect to the carrier frame to a forward declining extreme position, in which the front edge of the seat is displaced forwards and upwards with respect to the carrier frame.

By the displacement thus obtained of the seat front edge a better comfort for the user is obtained, since the front edge of the seat during movement from the backwards declining to the forward declining seat position will be displaced forwards and upwards while preserving complete back support, thereby adapting the height of the seat front edge above the floor to the user's more erect position. Correspondingly, during the opposite movement from the forward declining to the backwards declining seat position the seat front edge will be displaced backwards and downwards, thereby adapting the seat front edge to the opening of the angle between user's thighs and crus taking place during the backwards movement, thereby reducing the pressure of the seat front edge against the back of user's thighs. Both adjustment movements may thus be effected by the user at maximum comfort and with no change of his position on the seat and the user does not need to lift his feet from the floor.

To facilitate the adaptation of one and the same working chair to users of different height a comparatively simple adjustment mechanism may according to a further development of the invention be provided for simultaneous adjustment of the seat depth and the back height of the chair the back support comprises two substantially rectilinear parts forming an obtuse angle with each other, one of said parts being substantially vertical and connected with the back whereas the other is mounted in a back support holder positioned under the seat and connected with the carrier frame in such a manner that by means of an arrestable operating element it may be displaced in its longitudinal direction and maintained in various adjustments in said back support holder for simultaneous adjustment of the seat depth and the height adjustment of the back in relation to the seat.

Various further modifications of the working chair exist and will be described herein.

BRIEF DESCRIPTION OF THE DRAWINGS

The invention will now be explained in detail with reference to the schematical drawings which only show the details of embodiments of the working chair according to the invention, necessary to understand the invention.

In the drawings

DESCRIPTION OF THE PREFERRED EMBODIMENT

Figure 1:
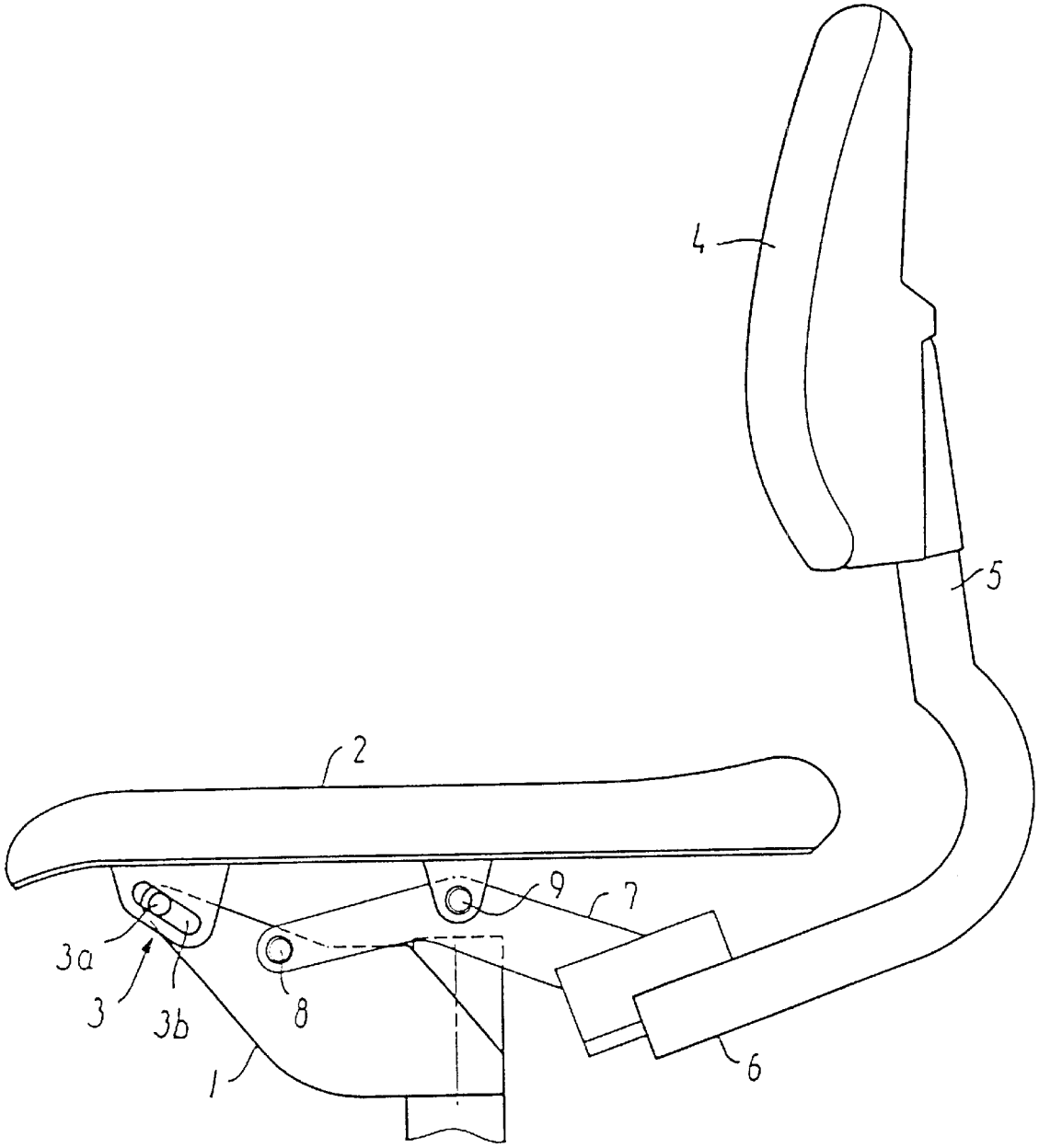
FIG. 1 shows a schematical side view of a comparatively simple embodiment.

In the embodiment in FIG. 1, a carrier frame 1 constitutes part of the lower frame of the chair, in that it is connected in a known manner with the upper end of a height-adjustable supporting pillar, not shown.

In the proximity of its front edge the seat 2 is pivotally connected with the carrier frame 1 by a first pivot connection 3.

By means of a pawl-rack mechanism of a design known per se the back 4 of the chair is mounted displaceably as to height on a back support 5 with a lower part 6 placed under the seat 2 which at its forward end is firmly connected with a mounting arm 7. At its forward end the mounting arm 7 is pivotally connected with the carrier frame 1 by a second pivot connection 8 and, in its central area, pivotally connected with the seat 2 by a third pivot connection 9.

The pivot connections 3, 8 and 9 have horizontal mutually parallel axes of rotation and allow a synchronous adjustment movement of the seat 2 and the back 4 so that the seat 2 from a backwards declining extreme position may be moved through a neutral position in which the seat plane is substantially horizontal to a forward declining extreme position and synchronously therewith the back may be moved from a backwards declining extreme position in which it forms a maximum angle with the seat towards a more erect position while gradually reducing its angle with the seat.

According to the invention the first pivot connection 3 is formed so that during the synchronous adjusting movement of the seat and back it allows a simultaneous, substantially translatory movement of the seat 2 perpendicular to the axis of rotation of the supporting pillar not shown of the chair, so that the front edge of the seat in the forward declining extreme position is displaced forwards and upwards in relation to the carrier frame 1 and in the backwards declining extreme position is displaced backwards and downwards in relation to the carrier frame 1.

To provide said translatory displacements the first pivot connection 3 comprises in the embodiment shown in FIG.1 a pivot pin 3*a* which is firmly mounted on the carrier frame 1 and is pivotally arranged and translatorily displaceable in a track 3*b* which is formed in connection with the support of the seat 2, e.g. in a flange portion connected therewith.

The track 3*b* may as shown be substantially rectilinear and directed obliquely upwards towards the front edge of the seat so that it, for instance, forms an angle of about 55° with the vertical axis of the supporting pillar not shown of the chair.

In the embodiment in FIG. 1 the variation range of the angle of the seat 2 with horizontal may typically extend from about −7° to about +3° while the accompanying adjustment area of the angle of the back 4 with the seat typically extends from a value of up to 15° larger than the seat back angle in the neutral position with a substantially horizontal seat plane to a value corresponding to the angle in the neutral position which typically amounts to about 98°.

Figure 2:
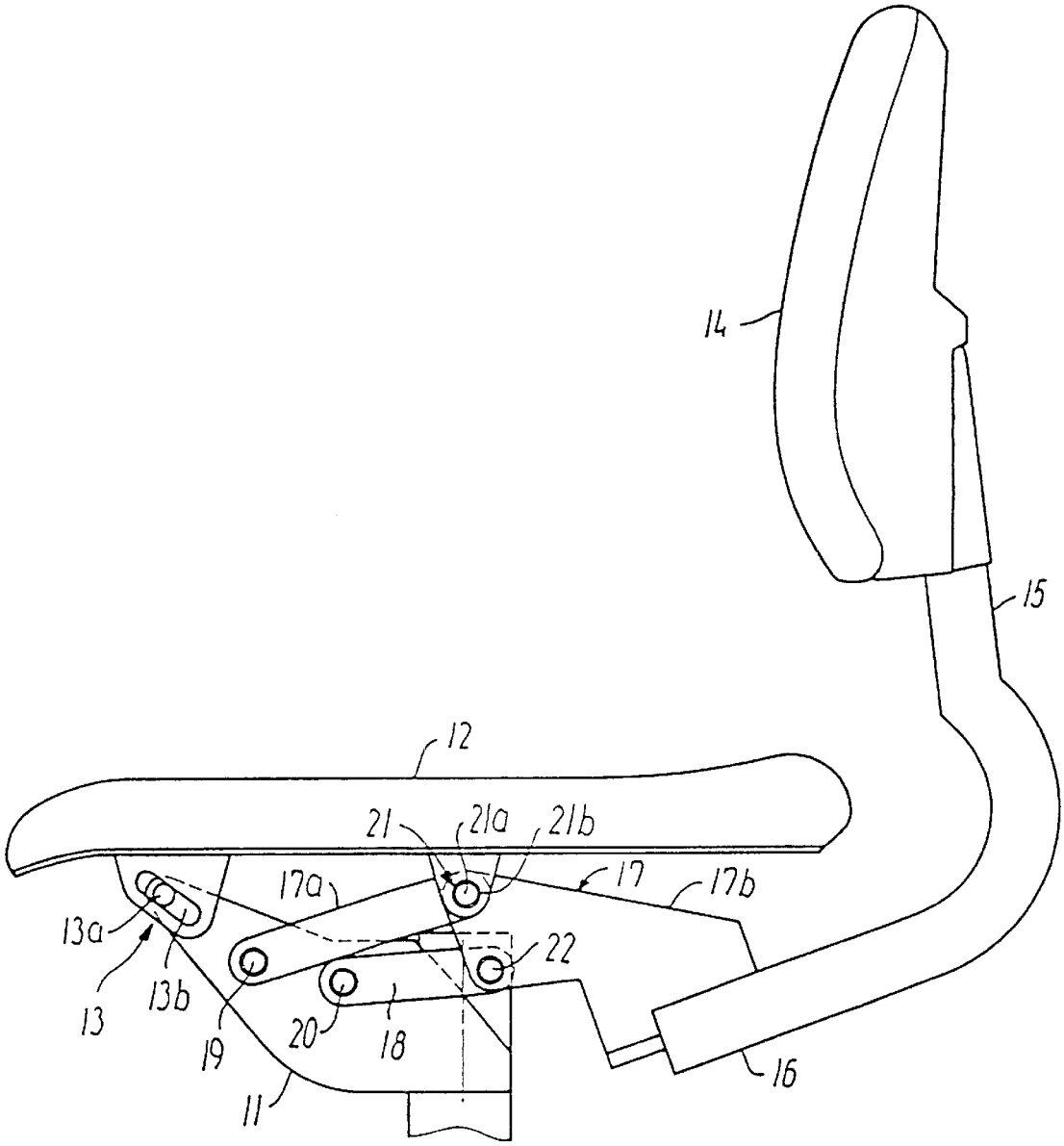
FIGS. 2 and 3 are schematical side views of an embodiment with increased area of adjustment of the seat angle in a neutral position and in two extreme positions or the seat inclination, respectively.
Figure 3:
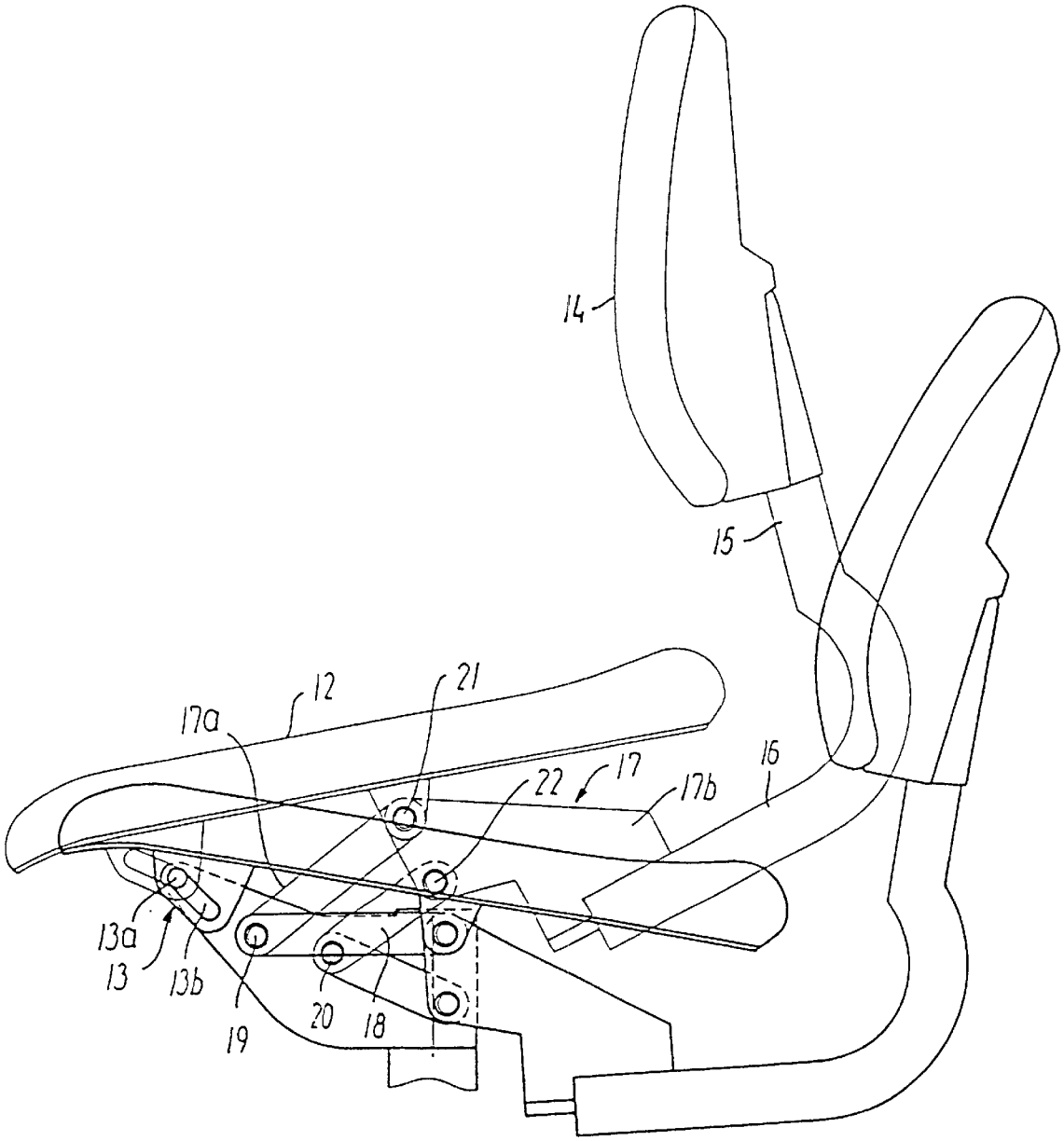

In the embodiment in FIGS. 2 and 3 the variation area of the seat inclination is, on one hand, increased through a modified design of the pivot connections between the carrier frame 11 and the seat 12, and, on the other hand, the back support 15 connected with the back 14.

The first pivot connection 13 between the carrier frame 11 and the seat 12 in the proximity of its front edge may be designed in the same manner as in the embodiment in FIG. 1 and include a pivot pin 13*a* firmly mounted in the carrier frame 11 in translatorily displaceable engagement with a track 13*b* in connection with the seat 12.

In the embodiment in FIGS. 2 and 3 the lower part 16 of the back support 15 positioned under the seat 12 is connected with the carrier frame 11 through two mounting arms 17 and 18 one mounting arm 17 comprising two mutually pivotally arm portions 17*a* and 17*b* of which arm portion 17*a* at its front end is pivotally connected with the carrier frame 11 in a pivot connection 19, whereas the second part 17*b* of the arm 17 is firmly connected with the back support 15 at the front end thereof.

Between the two arm parts 17*a* and 17*b* the arm 17 is further by a pivot connection 21 pivotally connected with the seat 12, in that the pivot connection may comprise a pivot pin 21*a* connected with the seat and journalled in journals 21*b* in each of the arm parts 17*a* and 17*b*. The other arm 18 is at its front end connected with the carrier frame 11 by a pivot connection 20 and at its rearwards end it is pivotally connected with the arm part 17*b* by a pivot connection 22.

Through this design the variation range of the seat inclination will be increased so that the seat angle with horizontal in the backwards and forwards declining extreme positions of the seat e.g. will be −10° and +10°, respectively.

The embodiment in FIGS. 2 and 3 thereby entails the further advantage that the seat-back angle not only in the backwards declining but also in the forward declining extreme position will be increased in relation to the value of the angle in the neutral position.

Figure 4:
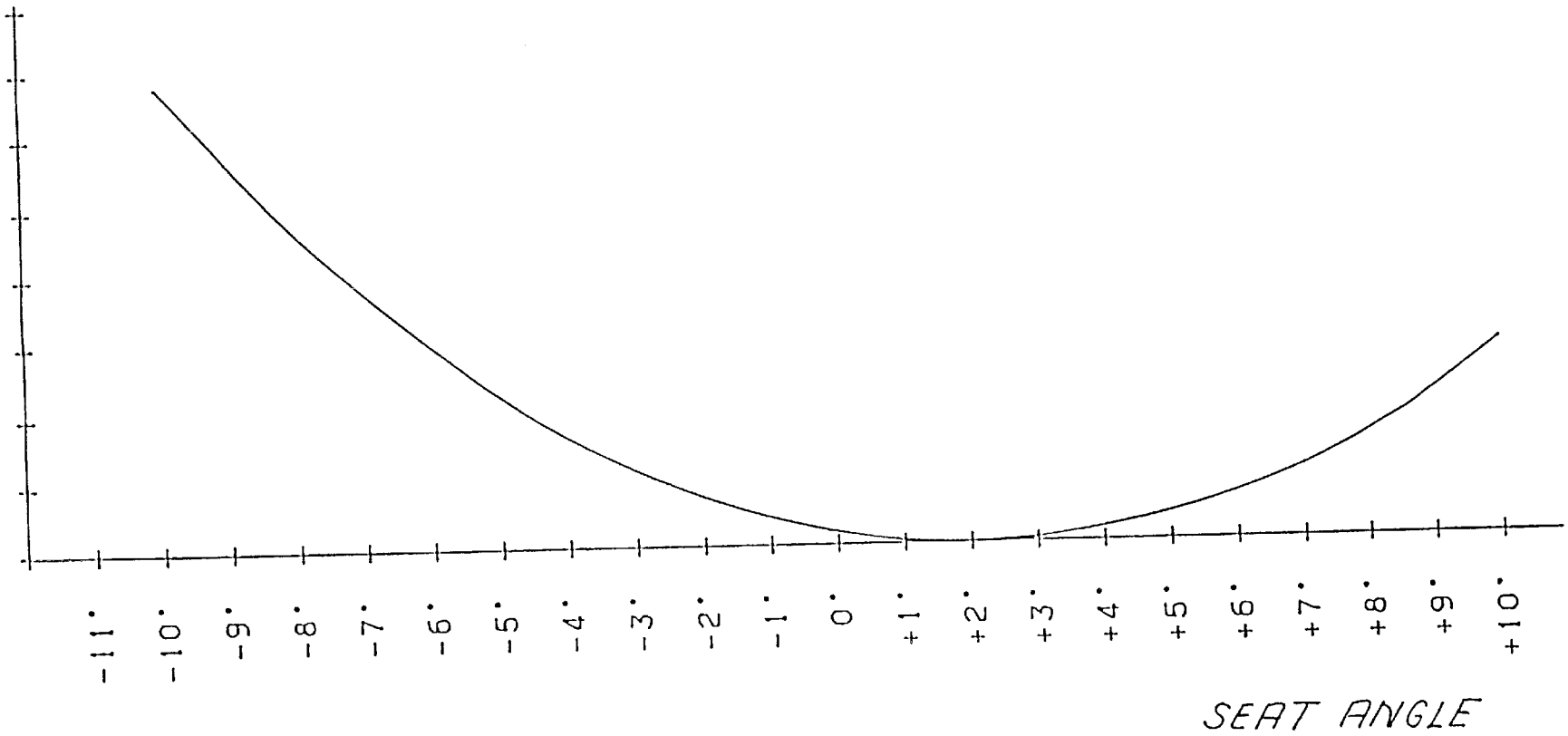
FIG. 4 is a graphic illustration of the variation of the seat back angle as a function of the angular position the seat.

The variation area may e.g. as sown in FIG. 4 extend from a value which in the backwards declining extreme position is about 7° larger than the seat-back angle in the neutral position and in the forward declining extreme position is increased by 3° larger.

It will be understood that the above details of the pivot connections between the carrier frame, the seat and the back support are provided at both sides of the chair, symmetrically about the center axis of the seat between the front edge and the back edge.

Figures 5, 6:
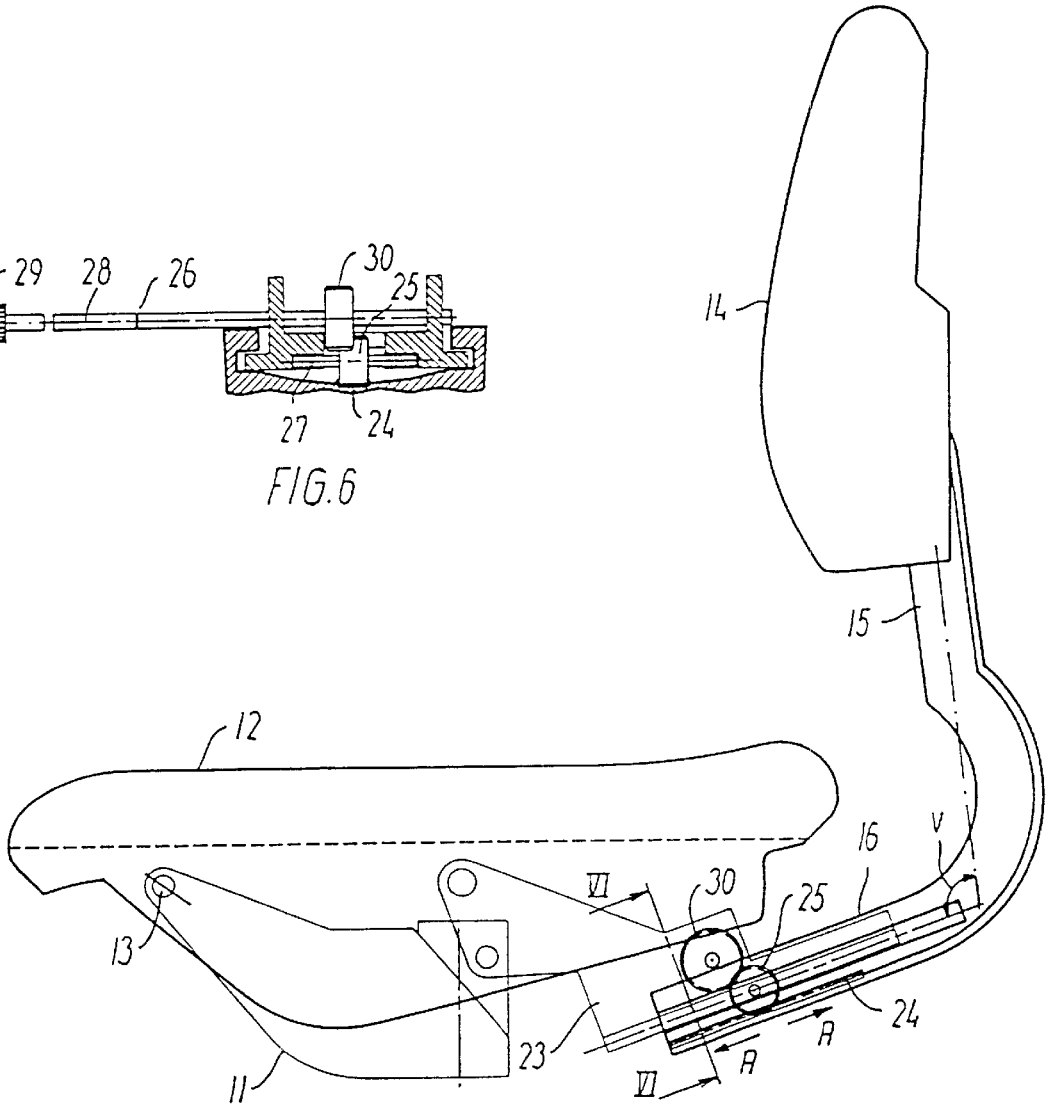
FIG. 5 is a side view of a modification of the embodiment shown in FIGS. 2 and 3 with a further adjustment mechanism for simultaneous adjustment of the seat depth and back height.
FIG. 6 is a section along the line VI—VI in FIG. 5.

In the embodiment shown in FIGS. 2 and 3 the two members 15 and 16 of the back support may as shown in FIG. 5, substantially rectilinear and form an obtuse angle V. The lower part 16 positioned under the seat is mounted in a back support holder 23 connected with the mounting arms 17 and 18, so that by means of an arrestable operating member it may be displaced in its longitudinal direction shown by the arrows A—A in the holder 23 and maintained in various adjustments in relation thereto.

The longitudinally displaceable and arrestable mounting of the back support holder 16 in holder 23 is in the illustrated embodiment provided in that the back support part 16 is formed with an elongated rack member 24 which is in engagement with a toothed wheel 25 mounted in the back support holder 23. By turning the toothed wheel 25 clockwise the rack member 24 and the back support 16 will thus be displaced in the forwards direction whereby the seat depth will be reduced. Vice versa, rotation of the wheel 25 counterclockwise will cause a backwards displacement of the rack member 24 and the back 14, thereby increasing the seat depth.

The arrestability of the engagement between the rack member 24 and the toothed wheel 25 may as shown in FIG. 6 be obtained by means of a releasable spring-biassed coupling, e.g. a claw clutch 26 between the shaft 27 of the toothed wheel 25 and the shaft 28 of a pivot handle 29 positioned outside the seat 2.

To obtain the most logical operation of the pivot handle 29 with no need that the user rises from the chair it is advantageous that the displacements backwards and forwards, respectively, of the back support holder 16 are effected by rotation backwards and forwards, respectively, of the pivot handle 29.

To obtain this, an intermediate wheel 30 may be inserted between the toothed wheel 25 and the clutch 26.

The obtuse angle V between the two back support parts 15 and 16 may in dependence on the other possibilities of adjustment of the chair vary between about 100° and about 120°. An advantageous size of the angle V is in practice 110°.

Since the lower back support part 16 positioned under the seat 12 will then be orientated obliquely forwards and downwards in relation to the seat plane an adjustment of the seat depth by means of the described adjustment mechanism will be followed by an automatic simultaneous adjustment as to height of the back 4 so that the height of back 4 above the seat 2 increases by increase of the seat depth and reduces by decrease of the seat depth.

The invention is not restricted to the illustrated and described embodiments, because the translatorily displaceable mounting of the seat, characteristic of the invention in relation to the carrier frame of the chair may be provided in another manner than illustrated and described.

What is claimed is:

1. A working chair with a seat (2, 12), a back (4, 14) and a lower frame, the frame comprises, a vertical adjustable supporting pillar and a carrier Frame (1,11) connected with an upper end of said pillar, the seat (2,12) being pivotally connected with said carrier frame in proximity of its front edge by a first pivot connection(3,13) with a horizontal axis of rotation,said first pivot connection (3, 13) comprising a pivot pin **(3*a*, 13*a*) connected with the seat (2, 12) and the carrier frame (1, 11), one of said seat and said carrier frame being provided with a track (3*b*, 13*b*) inclined with respect to a horizontal direction for allowing a substantially translatory movement of the seat (2, 12) perpendicular to the axis of rotation with respect to said carrier frame, whereas a mounting arm (7, 17) in firm connection with a back support(5, 15) connected with the back (4, 14) is pivotally connected with the carrier frame (1, 11) as well as with the seat (2, 12) by second and third pivot connections (8,9; 19,21) having axes of rotation mutually parallel and parallel with the axis of said first pivot connection (3, 13), said pivot connections being designed for synchronous movement of the seat (2, 12) and the back (4, 14), whereby the seat (2, 12) from a backwards declining rest position by rotation in said first pivot connection (3, 13) may be moved to a working position and the back (4, 14) synchronously therewith may be moved from a backwards declining extreme position in which it forms a maximum angle with the seat towards a more upright position while gradually reducing its angle with the seat, wherein the track (3*b*, 13*b*) is directed obliquely upwardly towards the front edge of the seat (2, 12) and is inclined at an angle of 40° to 70° with the vertical axis of the supporting pillar to provide a range of said translatory movement by which the seat (2, 12) is movable from said backwards declining rest position in which the front edge of the seat (2, 12) is displaced backwards and downwardly with respect to the carrier frame (1, 11) to a forward declining extreme position, in which the front edge of the seat (2, 12)is displaced forwardly and upwardly with respect to the carrier frame (1, 11)**.

2. The working chair as claimed in claim 1 characterized in that said track **(3*b*, 13*b*)** is provided by a member connected with the seat.

3. The working chair according to claim 1, characterized in that the back support comprises two substantially rectilinear parts (15, 16) forming an obtuse angle (V) with each other and of which one (15) is substantially vertical and connected with. the back (14), whereas the other is mounted in a back support holder (23) positioned under the seat (12) and connected with the carrier frame (11) in such a manner that by means of an arrestable operating member (25), it may be displaced in its longitudinal direction and be maintained in various adjustments in said back support holder (23) for simultaneous adjustment of the seat depth and the height adjustment of the back in relation to the sea (12).

4. The working chair according to claim 3, characterized in that said second part (16) of the back support includes an elongated rack member (24), and that the operating member includes a toothed wheel (25) engaging a tooth of the rack member (24), wherein a releasable clutch (26) is connected with a pivot handle (29).

5. The working chair according to claim 4, characterized in that a transmission (30) is provided between the toothed wheel (25) and the pivot handle (29), said transmission being provided so that said second part (16) of the back support is displaced backwards and upwardly in relation to the seat by rotation of the pivot handle (29).

6. The working chair according to claim 1, characterized in that the back support (15) is connected with the carrier frame through two mounting arms (17,18), wherein one (17) of the arms includes two mutually pivotally connected arm portions **(17*a*, 17*b*), one of which is pivotally connected with the carrier frame (11) while the other is in firm connection with the back support (15), whereas the pivotal connection (21) between the two arm portions (17*a*, 17*b*) forms part of said pivot connection with the seat (12), the second mounting arm (18) being pivotally connected with the carrier frame (11) and with the portion (17*b*) of the first arm (17) connected with the back support (15)**.

7. The working chair according to claim 6, characterized that in each of said backwards declining and forward declining extreme positions, the seat (12) forms an angle of about 10° with the horizontal direction in both of said extreme positions, the angle of the back (14) with the seat (12) is larger than in a neutral position between said extreme positions.

8. The working chair according to claim 7, characterized in that the angle of the back (14) with the seat (12) in the backwards declining extreme position of the seat is about 7° larger and in the forward declining extreme position of the seat is about 3° larger than in said neutral position.

9. The working chair according to claim 2, characterized in that the back support (15) is connected with the carrier frame through two mounting arms (17,18), wherein one (17) of the arms includes two mutually pivotally connected arm portions (17*a*, 17*b*), one of which is pivotally connected with the carrier frame (11) while the other is in firm connection with the back support (15), whereas the pivotal connection (21) between the two arm portions (17*a*, 17*b*) forms part of said pivot connection with the seat (12), the second mounting arm (18) being pivotally connected with the carrier frame (11) and with the portion (17*b*) of the first arm (17) connected with the back support (15).

10. A working chair according to claim 9, characterized in that in each of said backwards declining and forward declining extreme positions the seat (12) forms an angle of about 10° with the horizontal direction and that in both of said extreme positions, the angle of the back (14) with the seat (12) is larger than in a neutral position between said positions.

11. A working chair according to claim 10, characterized in that the angle of the back (14) with the seat (12) in the backwards declining extreme position thereof is about 7° larger and in the forward declining extreme position of the seat is about 3° larger than in said neutral position, in which said angle presents its minimum value.

* * * * *